United States Patent [19]

Gorlich

[11] Patent Number: 5,042,540

[45] Date of Patent: Aug. 27, 1991

[54] DEVICE FOR PLACING PRODUCTS IN SEALABLE CONTAINERS WHILE MAINTAINING THE INTEGRITY OF THE SEAL

[76] Inventor: Michael P. Gorlich, 12657 Crossbow Dr., Manassas, Va. 22111

[21] Appl. No.: 521,583

[22] Filed: May 10, 1990

[51] Int. Cl.[5] ..... B65B 43/54

[52] U.S. Cl. ..... 141/174; 141/89; 141/133; 141/169; 141/369; 134/131; 198/604

[58] Field of Search ..... 141/36, 89, 91, 129, 141/163, 165, 168, 173, 174, 237, 246, 167, 369, 370, 372, 373, 131, 132, 133, 134; 198/604, 605; 134/131

[56] References Cited

U.S. PATENT DOCUMENTS

| | | | |
|---|---|---|---|
| 751,360 | 2/1904 | Tenney . | |
| 1,305,584 | 6/1919 | Yahle . | |
| 1,813,021 | 7/1931 | Brown | 141/89 |
| 2,058,976 | 10/1936 | Gray . | |
| 2,261,548 | 11/1941 | Gridley et al. . | |
| 2,685,395 | 8/1954 | Levine . | |
| 3,152,622 | 10/1964 | Rothermel | 141/134 |
| 3,314,454 | 4/1967 | Wood | 141/72 |
| 3,464,324 | 9/1969 | Pinkham | 141/131 |
| 3,528,259 | 9/1970 | Saal | 134/131 |
| 3,538,997 | 11/1970 | Christine et al. | 198/803.15 |
| 3,602,401 | 8/1971 | Lense | 141/129 |
| 4,307,761 | 12/1981 | Harvey | 141/183 |

FOREIGN PATENT DOCUMENTS 1055607 12/1952 France .

OTHER PUBLICATIONS

Multivac R 7000 catalog.

*Primary Examiner*—Ernest G. Cusick
*Attorney, Agent, or Firm*—Arnold, White & Durkee

[57] ABSTRACT

A filing system which prevents the contamination of a container's sealing surface during the system's filling procedure is disclosed. A first endless belt is used to convey a succession of containers below a second endless belt. The first and second endless belts travel synronously and in the same direction. A similar succession of shields is attached to the second endless belt. As the two belts converge, the shields separately protrude into and extend over the open end of the laterally traveling containers. The shields prevent product or other contaminants from depositing on the containers' sealing surfaces as the containers are filled. Drip guards positioned on the downstream portion of the second endless belt collect drippage from each shield as it is removed from its seal protecting position within each container. The first and second endless belts are sanitized on every revolution to further prevent container contamination.

17 Claims, 3 Drawing Sheets

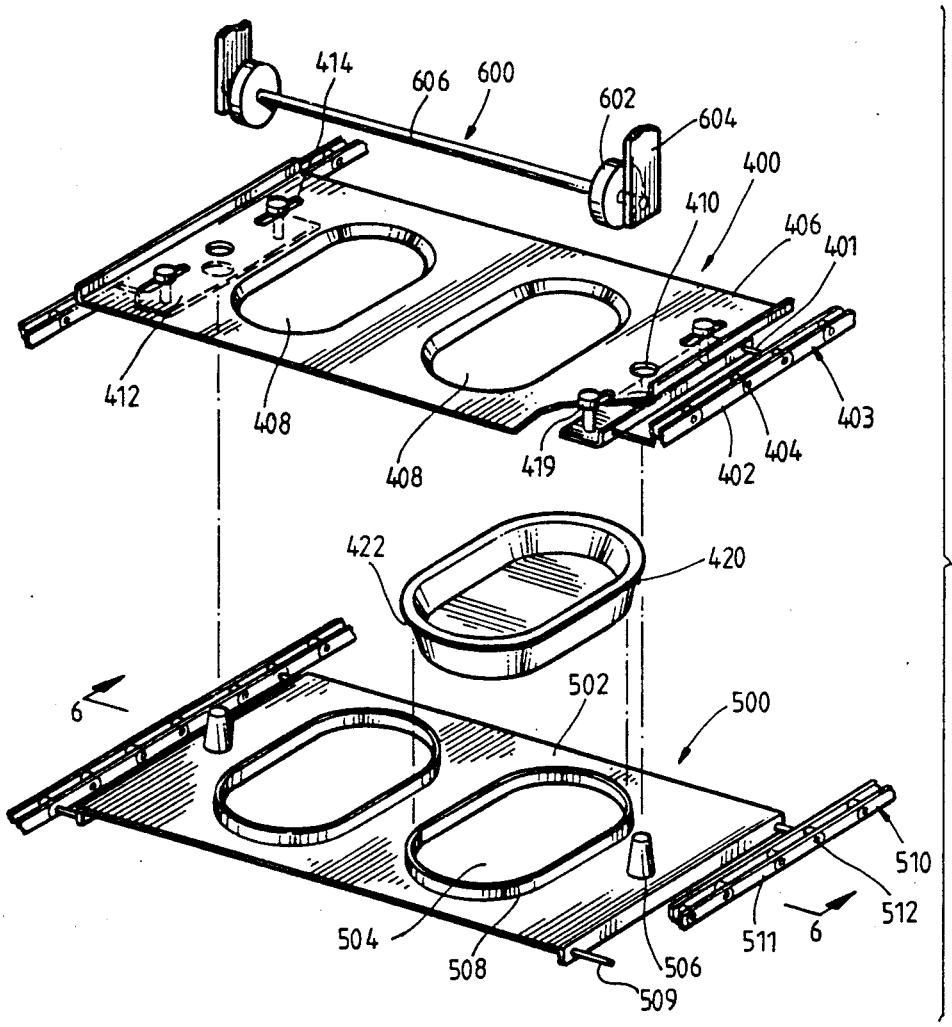
FIG.4
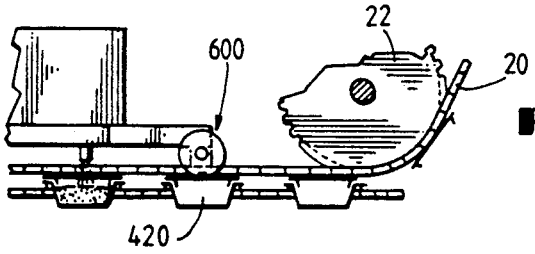
FIG.5
FIG.6
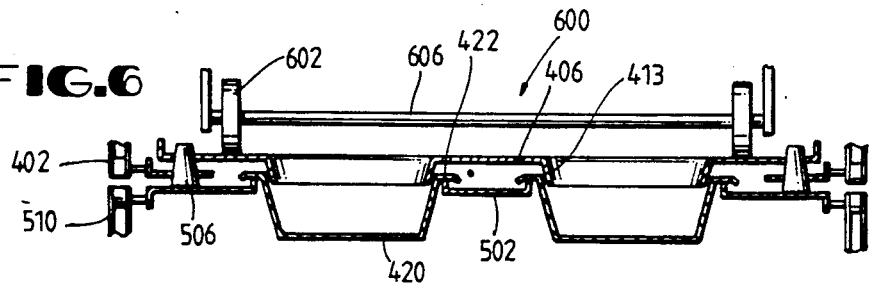

DEVICE FOR PLACING PRODUCTS IN SEALABLE CONTAINERS WHILE MAINTAINING THE INTEGRITY OF THE SEAL

BACKGROUND OF THE INVENTION

1. Field of the Invention

The present invention relates generally to a system for filling containers adapted to maintain a gas tight seal. More specifically the present invention relates to an automated system for placing a given product in a sealable package while reducing or substantially eliminating contaimination to the sealing surface of said package caused during the filing or loading operation.

2. Description of the Prior Art

The increasing popularity of perishable food products is largely a result of advances made in the development of systems for containment and storage of such products for purposes of transportation and subsequent presentation to the consumer. Containment and storage systems have allowed the ready transportation of even highly perishable foods over great distances. Moreover, such systems have served to substantially impede product contamination and spoilage of food products and other products sensitive to contamination. Automatic or semi-automatic containment systems have also enabled the cost of many products to remain at a relatively low level while simultaneously enabling a high production output of such products in a containerized form.

The most commonly known containment system is accomplished by sealing the product in a metallic can whereby a metallic lid is crimped thereon to establish an airtight seal. In a canned system, the perishable product is preserved in a palatable state via the introduction of a number of preservatives such as nitrates or the like. Such systems are easily adapted to automatic and mechanized loading processes. Moreover, such canning systems are relatively unaffected by contamination of the sealing edge of the container prior to the placement of the top and subsequent crimping. Disadvantages of canned systems reside in the overall taste and appearance of the food product. Such products are not fresh in the technical sense and are therefore often not preferred in relation to fresh produce or meat products.

Alternatives to canned products exist in the form of frozen food products. In most forms of frozen food products, food stuffs are introduced into a container whereupon a lid is sealed over the food stuffs and the entire container subjected to below freezing temperatures. Frozen food packaging offers the advantage of a diminished need for food preservatives. Additionally, frozen food products offer an advantage from the standpoint of sealing the container itself, since contaminants introduced on the sealing surface ordinarily do not flourish in a low temperature environment. Disadvantages of frozen food products reside in the lack of the fresh food state of the end product. Moreover, many foods, especially poultry and vegetable products, tend to loose flavor and appearance as a result of the freezing process.

The foregoing containment techniques have been superseded in recent years by the introduction of systems adapted to contain a fresh food product in a vacuum or modified gas atmosphere. Such systems ordinarily consist of a tray on which is mounted a plastic lid or wrapper. This lid or wrapper must be sealed securely to the bottom tray in a fashion such as to establish an airtight fit. In an ordinary case, such an airtight seal is accomplished via the use of a bottom tray having a flat lip or flange over which may be placed the lid or alternatively a plastic film.

Disadvantages of such techniques have heretofore resided in the lack of an ability to maintain a gas tight seal between the top and the lid of the container. Such problems are usually caused by contamination of the sealing surface of the bottom tray. Contamination usually occurs during the filling procedure.

Contamination of the sealing surface does not allow a gas tight seal to be created in the package. In this respect, it has been estimated that fresh food containers utilizing such filling systems have on the average experienced almost a 15% contamination rate. As might be expected, this contamination has resulted in reduced customer confidence in the packaging, increased instances of spoilage, and increased costs due to the need to manually examine each seal.

SUMMARY OF THE INVENTION

The present invention addresses the above-noted and other disadvantages by providing a system for filling gas flush or vacuum type containers in an automated or semi-automated fashion while preserving the integrity of the sealing lip or flange so as to allow the creation and maintenance of a gas tight seal between the lid and the tray itself.

Structurally, the present invention consists of an endless track conveyor system, or belt which is disposed above and in an operatively aligned relationship with a second conveyor system, or belt where said second system is adapted to move a product or container in a linear fashion through an area wherein a product, e.g. a fresh food product, is introduced into the container. In a preferred embodiment, the invention includes a number of specially configured shields or barriers which are mounted on the upper conveyor system for movement in a direction and speed substantially identical to that of the lower conveyor system. These shields are preferably provided with apertures closely configured to the size and shape of the interior of the containers moved along the lower conveyor system. These shields or barriers are adapted to fit closely within but in a non-contacting relationship with the upper, open portion of the container, when the containers are moved beneath automated food dispensing or filling mechanisms. In such a fashion, food products are introduced through the shield into the food tray. Splatter or other contamination resultant from the filling operation is directed on the barriers or shields and is thereby prevented from coming into contact with the flange or lip of the food container. In such a fashion, the integrity of this sealing surface itself is maintained during the food filing operation.

In a preferred embodiment, the invention is provided with an automated means to maintain the relative cleanliness of the shields or covers themselves during the food filing operation. This is accomplished by the use of an automated cleaning or sterilization system which is disposed along the upper or lower conveyor systems and is adapted to receive the shields or tray support members in an automated fashion. In such a fashion, potentially contaminating residue will not be allowed to contact the fresh food product, and alternately, will not contact the sealing lip of the food package.

In a second preferred embodiment, means are provided to maintain the synchronous relationship between the upper and lower conveyor assemblies so as to ensure precise alignment during the food filing operation. This alignment system generally comprises indexing or alignment pins which extend from either the barrier or the food support members and are receivable in oversized apertures disposed in the corresponding members in the upper or lower conveyor systems.

The present invention offers a number of advantages over the prior art. One such advantage is the ability to maintain a contamination-free sealing surface preparatory to the application of a sealing top so as to maintain a desired atmosphere within a vacuum or modified atmosphere package.

A second advantage is the ability to automatically maintain the precise alignment between lengthy conveyance systems disposed in synchronous, contacting alignment with each other.

Yet a third advantage is the ability to automatically maintain the sterility of an automated food introduction assembly.

BRIEF DESCRIPTION OF THE DRAWINGS

FIG. 4 is a perspective view of a second embodiment of the present invention illustrating a preferred embodiment of the alignment mechanism.

FIG. 5 is a side view of the embodiment illustrated in FIG. 4 showing the operation of the alignment mechanism.

FIG. 6 is an end view of the embodiment illustrated in FIG. 4 taken along line 6—6, illustrating the interrelation of the alignment mechanism.

DETAILED DESCRIPTION OF THE DRAWINGS

Figure 1:
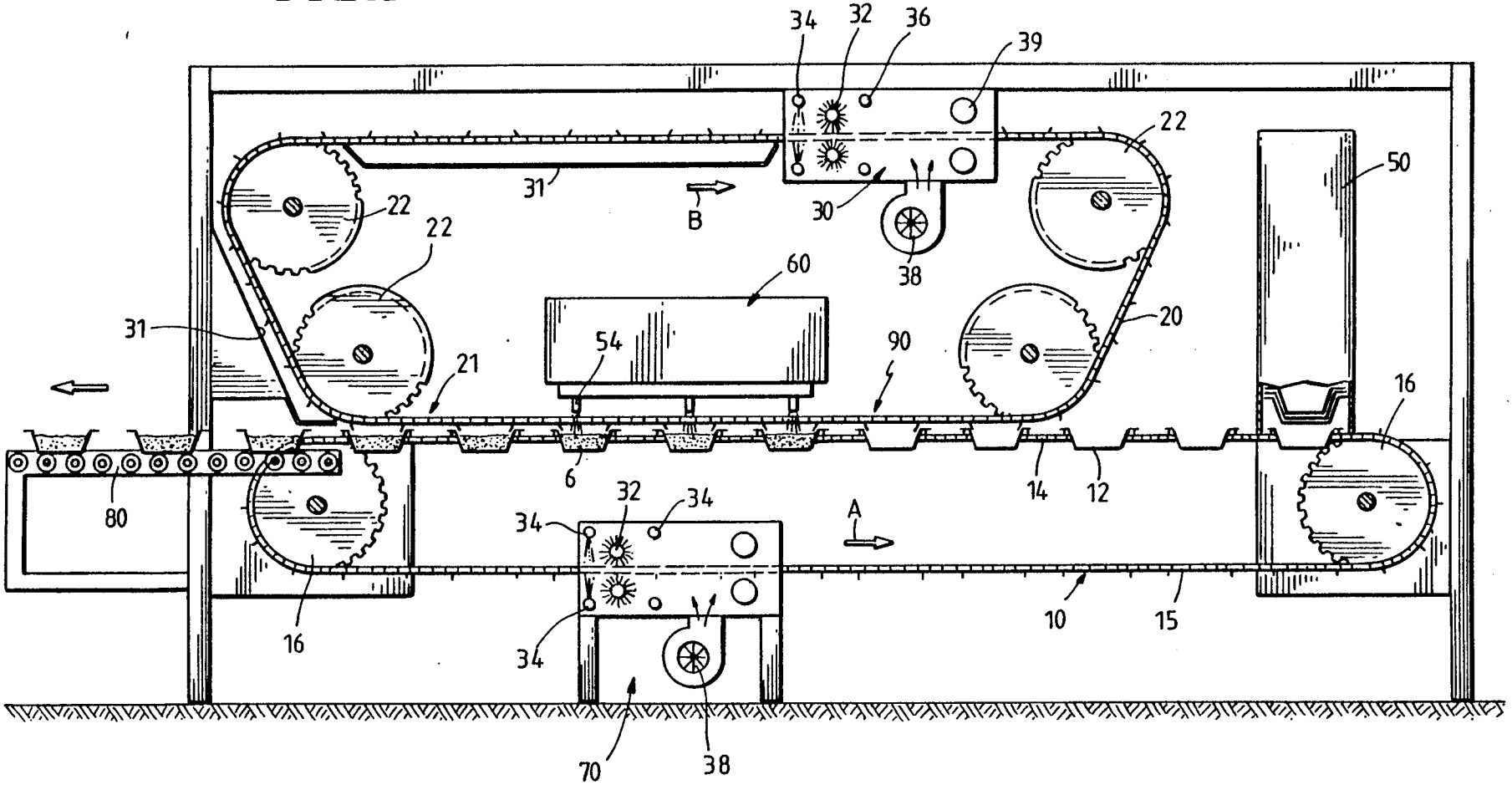
FIG. 1 is a side, cutaway view of a general embodiment of the present invention illustrating the relative position of the shielding system in relation to the food tray and support means.
Figure 2:
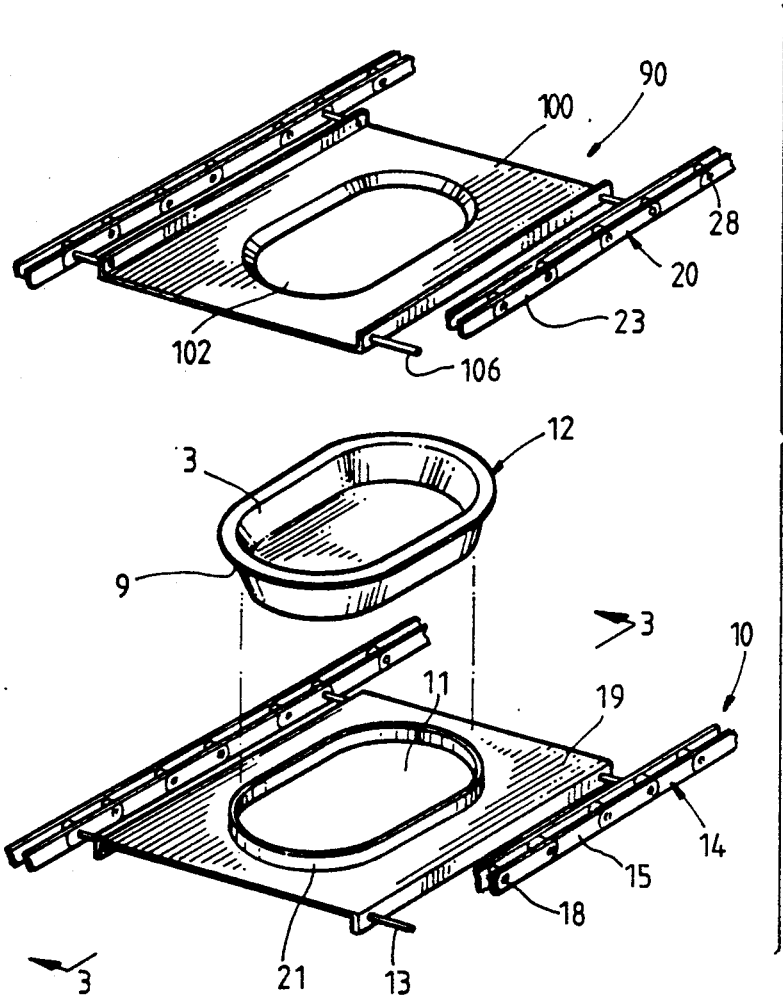
FIG. 2 is a perspective view of a preferred embodiment of the invention illustrating the relationship of the shielding system in relation to the food tray and support means.
Figure 3:
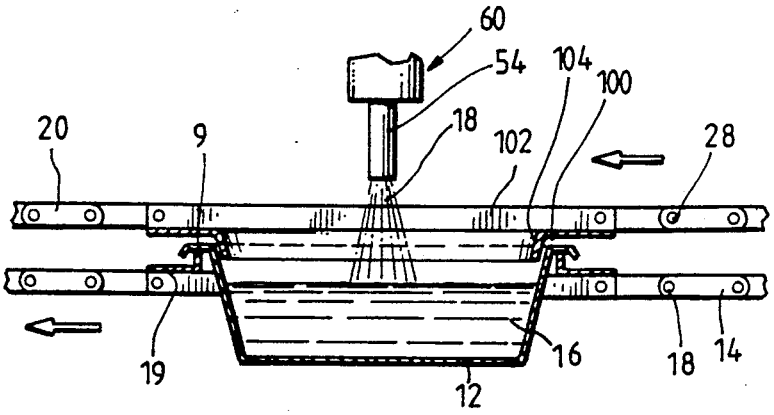
FIG. 3 is a detail, cross-sectional view taken along lines 3—3 in FIG. 2 illustrating the relative juxtaposition of the shielding system and food tray support means as they would appear during a filling operation.

A general embodiment of the present invention may be seen by reference to FIGS. 1–3. FIG. 1 illustrates a side view of a conveyor assembly 10 which has been adapted to move a series of food containers 12 in a right to left, longitudinal fashion. FIG. 1 also illustrates a second endless track conveyor assembly 90 which is positioned above and in operative engagement with lower assembly 10 as shown. Lower assembly 10 generally comprises a selectively sized support member 19 disposed between a pair of belts 15 which are oriented in a parallel, closed loop arrangement so as to form a substantially integral unit. In a conventional embodiment, support member 19 is coupled to belts 15 via supporting pins 13. Belts themselves are generally comprised of a series of linkages, preferably metal, pivotally coupled via a fastener 18 in an end-to-end fashion. In such a fashion, the assembly including support member 19 and belts 15 is capable of considerable flexibility about its longitudinal axis. As will be seen, lower assembly 10 generally comprises a conventional conveyor system which has been modified to accommodate containers of a selected design.

In a general embodiment, belts 15 are operatively disposed about drive sprockets 16 which are themselves coupled to a conventional drive means which usually includes an electric motor or the like. In the embodiment illustrated in FIG. 1, assembly 10 is adapted to move in a counterclockwise direction as indicated by letter "A" such that articles placed thereon will move in a right to left fashion. The operation of assembly 10 is preferably governed by a central control system as will be further discussed herein. It is desirable that the operation of conveyor assembly 10 is compatible with that of assembly 90 in terms of both speed and direction.

Assembly 10 defines an upper support surface which is adapted to move selected articles, and especially food trays 12 or the like, in a longitudinal fashion as illustrated in FIG. 1. Referring to FIGS. 2–3, support member 19 is preferably provided with an appropriately shaped aperture 11 adapted to match the bottom exterior of food trays 12. In one preferred embodiment, support member 19 is also provided with a tray supporting flange 21 adapted to support the package or tray 12 above its upper surface. In such a fashion, any moisture or residue deposited on support member 19 will not contact tray lip or flange 9. Apertures 11 also prevent movement of tray 12 during the food filing process, and further ensure precise alignment of tray 12 on support member 19.

Other means to support trays 12 in a spaced, fixed position are also envisioned within the spirit of the present invention. For example, support members may be provided with a raised platform to hold trays 12. Alternately, trays 12 may be held in position via a conventional suction mechanism or the like.

Assembly 10 may be provided with a conventional package or tray denester 50 situated relative assembly 10 so as to automatically provide a continuous supply of trays 12 to lower conveyor 10. An example of such a mechanism is a tray denester manufactured by THIELE. Alternatively, trays may be placed on assembly in a manual or other fashion as will become obvious to one skilled in the art. Assembly 10 may be further provided with a conventional food dispensing device 60 which is preferably disposed above assembly 10 so as to allow for the selected placement of a product 6 in trays 12 via nozzles 34. Examples of such filing systems are food filing and dispensing systems manufactured by ALL-FILL. The operation of dispensing device 60 and denester 50 are necessarily coordinated with the movement of conveyor assembly 10 so as to ensure proper tray and material placement as will be further discussed herein.

Conveyor assembly 10 is adapted to operatively interface with the upper, second conveyor assembly 90. In a preferred embodiment, conveyor assembly 90 is comprised of a shielding or barrier member 100 disposed between two parallel belts 20 via pins or support members 106, where said belts 20 are oriented in a parallel, endless loop arrangement. The use of connection pins 106 allows for rapid removal and replacement of shield members 100 so as to optimize system flexibility, although other attachment means are envisioned. Belts 20 are preferably of metallic construction although the use of elastic belts or the like is contemplated within the spirit of the present invention. As described in connection with assembly 10, belts 20 preferably comprise a series of linkages 23 pivotally secured in an end-to-end fashion via fasteners 28.

Figure 7:
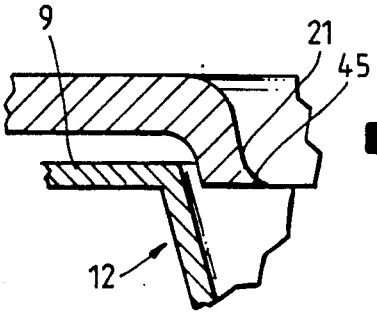
FIG. 7 is a detailed cross section of the barrier or shield member.

As noted, assembly 90 generally consists of a plurality of shielding members 100 disposed in an endless track manner which is designed to operate in a coordinated fashion with lower assembly 10. In this connection, shield members 100 are adapted to fit immediately over trays 12 when trays 12 are moved beneath food dispensing assembly 60. To allow for the dispensing of food or other matter into trays 12, shield members are provided with appropriately sized apertures 102 which are preferably of a size somewhat smaller than the opening 3 defined in tray 12. In a preferred embodiment, shield member 100 is provided with a downwardly extending lip 104, which lip defines an increasingly smaller diameter at its downwardmost extent. In this connection, lip 21, when viewed in cross section, generally defines a truncated cone or funnel having its apex situated in a downward direction. To prevent drippage, lip 21 may be provided with an upturned bottom surface 45. (See FIG. 7).

Shield member 100 is designed to interface with tray 12 during the operation of dispensing apparatus 60. Absent the presence of shielding member 100, food or other products dispensed through mechanism 60 would be prone to splatter or otherwise contaminate the sealing lip 9 of tray 12. As earlier noted, however, gas flush or vacuum packaging often utilizes a plastic or cellophane type cover which must be affixed to sealing lip 9. For this reason, the integrity of lip 9 is very significant. Once lip is contaminated, the difficulty involved in the creation of a sealed airtight container is greatly enhanced.

Shield member 100 serves to prevent the contamination of the upper portion of sealing lip 9 of tray 12 by serving as a physical barrier. Matter 56 discharged from nozzle 54 is further prevented from contacting lip 9 by the downwardly distending lip 104 of barrier member 100. In addition, shield member 100 physically prevents food matter previously in the tray 12 from being splattered onto sealing lip 9.

To accomplish adequate coverage of lip 9, it is desired that lip 104 of member 100 distend at least below the level of the sealing edge or lip 9 of package 12. The exact downward length of lip 104 will depend on various factors including the type of materials to be introduced into the tray, the nature of the filling operation, the physical characteristics of tray 12, the amount of product which is introduced in the tray 12, and the amount of product which is introduced in the tray 12. It is desirable that the maximum exterior configuration of lip 104 be of a smaller size than the size of the opening 3 formed in tray 12. This is necessary to facilitate automatic operation and to prevent the upward movement or "wicking" of nonviscous foods such as soups or gravies between the innermost extent of tray 12 and the outermost extent of lip 104. The amount of this tolerance will depend to a large part on the material to be introduced into the tray 12. For example, if a liquid food product such as soup is to be introduced into the tray 12, a tolerance of 1/32" would be preferred. For a different product, e.g. vegetables, a larger tolerance of 3/32" may be employed. In general, therefore, the dimension of the preferred tolerance varies with the consistency of the material introduced into the container.

The inventive concept previously disclosed in connection with FIGS. 1-3 may be adapted for use with assemblies capable of filling a plurality of trays at a given instant. One such alternate embodiment is illustrated in FIG. 4. FIG. 4 illustrates an upper 600 and lower 500 conveyor assembly which are adapted to operate in a similar manner to the embodiment disclosed in relation to FIGS. 1-3. By general reference to FIG. 4 may be seen an upper shielding member 406 disposed between a pair of belts 403 which are oriented in a parallel fashion, where said belts are comprised of a plurality of links 402 joined together in an end-to-end fashion via fasteners 404. As previously observed in connection with the general embodiment, shielding member 406 is preferably provided with a pair of apertures 408 the bottommost extent of which defines a pair of flanges or lips 413. As previously described, the configuration of apertures 408 and lips 413 is defined in large part by the structure of trays 420 and the subject matter to be introduced therein. Trays 420 are receivable in apertures 504 formed in support member 502, and preferably rest on upwardly extending flanges 508 formed thereon. Support member 502 is disposed between a pair of belts 510 which are again oriented in a parallel fashion as earlier described.

The effectiveness of the present invention in preventing contamination to the sealing surfaces of gas flush, vacuum and other packaging is dependent to a significant degree on the precise, physical juxtaposition of the shield members relative to the package lip. As might be expected, even minor variations in the relative positioning of the upper and lower conveyance systems can fail to reduce such contamination, or in some cases, may even serve to enhance contamination to the sealing surfaces of the packaging. As a result, it is desirable that the relative positions of upper conveyance systems be synchronized through the use of a single motor, or a series of motors coupled to a central control system. An example of such a motor is the mechanical or electrical servo motor manufactured by CAMCO.

In instances where the invention is driven by one or more drive means, it is nevertheless necessary to ensure exact, physical alignment between the upper and lower conveyor assemblies. This requirement is enhanced depending on the overall length of the drive belts. It is usually impossible, however, to align belts over 25 feet in total length by conventional techniques. To overcome these difficulties and ensure precise alignment between the upper and lower conveyor assemblies, a preferred embodiment of the invention employs a mechanical mating or alignment assembly which may be integrated into the aforedescribed upper 90 and lower 10 conveyor assemblies.

A preferred embodiment of the mating assembly may be seen by reference to FIGS. 4-6. Referring to FIG. 4, support plate 502 may be provided with two or more upwardly extending alignment pins 506 which are receivable in corresponding apertures 410 formed in tray support member 406. Alignment pins 506 are preferably tapered such that the diameter of pin 506 is greater at its base than at its top. The specific dimensions of pin 506 will vary dependent on a number of factors including the dimensions of the tray 420, the length of conveyor 10, and the nature of the material to be introduced into trays 12. For example, in systems utilizing a thirty foot long bottom conveyor 90, an alignment pin 506 having a one-half inch maximum base diameter is preferred. It is preferred that pins 506 be of sufficient length to engage tray support member 406.

Alignment pins 506 operate in conjunction with alignment apertures 410 which are situated along the edges of shield member 406 in a fashion generally compatible to the positioning of alignment pins 506. In such a fashion, complete insertion of pins 506 into apertures 410 results in a desired alignment of shield member about tray 420. Apertures 410 are of a sufficient diameter to allow considerable lateral and longitudinal "play" of shield member 406 when initially aligned with the upper tapered end of pin 506. This "play" is reduced as the shield member 406 and support members 502 are brought into a closer contacting relation whereby aperture 410 is brought into closer proximity with the larger diameter base of alignment pin 506. In such a fashion any "play" between member 406 and 502 is substantially eliminated when the shield member 406 and support member are brought into a close operating relationship as illustrated in FIG. 6. Though FIGS. 4–6 illustrate the precise alignment of pins 506 and apertures 410 in respective relationship to the food support and shielding members, 502 and 406, respectively, it is contemplated that it may be desirable to reverse these relative orientations.

In some applications, especially where very long conveyors are contemplated, it may be desirable to provide the upper or lower conveyance system with yet a supplemental alignment mechanism to enable proper alignment therebetween. Such a system may be seen by reference to FIG. 4. In FIG. 4, shield member 406 is provided with a pair of slots 414 receivable to pins 419 which are secured to a bottom plate or rail 412 which is secured to belt 403 via pins 401. As illustrated, pins 419 are provided with a head having a diameter greater than the width of slots 414. Shield member 406 is thus capable of longitudinal displacement in an amount limited only by the length of slots 414 and the proximity of adjacent shield members 406.

In some embodiments, it may be desireable to provide a mechanism to urge the relative alignment of the upper and lower conveyers. Referring to FIGS. 4–6, one embodiment of alignment mechanism 600 comprises a plurality of contact members 602, preferably wheels or the like, secured along axle 606 which is designed to rotate relative to supporting brackets 604. Alignment mechanism operates by providing a downward force on the shield or barrier members 400 of the upper assembly so as to promote the "seating" of shielding members about alignment pins 506. In such a fashion, a secure fit is ensured between barrier members 406 and trays 420.

Operation of the present invention in conjunction with a modified endless track conveyor system of a modified conventional design will substantially reduce and even eliminate the contamination of the package sealing lip. This improvement is brought about because the aforedescribed shield member serves a physical barrier to splash and splatter. As a consequence of this function, however, it is envisioned that residue will begin to collect and build up on the shield members, especially the downwardly distending flanges, unless periodic cleaning is undertaken. It might also be expected that the failure to implement a rigorous cleaning procedure will result in undesired bacterial growth which might present an unsanitary condition. Further, if the materials injected through the shield member 6 are of a low viscosity, there is also presented the possibility of drippage from the shield member onto the tray sealing surface. As a consequence of these problems, it is preferable that each shield or food supporting member be sterilized and dried after each application.

For a preferred embodiment illustrated in FIG. 1, an upper cleaning assembly 30 is situated along upper conveyor 90 at a position generally opposite food dispensing system 60, although many other relative positions are envisioned within the spirit of the present invention. Assembly 30 generally comprises one or more spray nozzles 34 and 36 disposed above and below conveyor 90 and adapted to apply a high pressure spray of air, water, solvent, etc. over shield members 100. Removal of matter may be added by use of rotating brushes 32 or the like. Finally, cleaning assembly 30 may be provided with an air drying means 38 and an ultraviolet drying and disinfectant assembly 39. In such a fashion, shield member are both cleansed, dried and decontaminated before again being utilized. A similar cleaning and disinfecting apparatus may be performed by a secondary cleaning assembly 70 situated on lower conveyor assembly 70 as illustrated.

To further prevent against the inadvertent drippage of containments resultant from the movement of upper 90 and lower 10 assemblies, splash shields 31 may be integrated into these conveyance systems in a fashion illustrated in FIG. 1. These splash shields 31 may be provided with drainage vents in the like (not shown) to remove potentially contaminating solutions or may be provided with automatic drainage systems of generally conventional designs.

What is claimed is:

1. An apparatus for reducing the contamination attendant to the placement of a given product into a container having a sealing flange about its upper, open end, comprising:

a first belt adapted to move a plurality of said containers in a longitudinal, spaced relation;

a filling means disposed above said first belt and adapted to place a product in said container;

a second belt disposed above said first belt and situated in longitudinal, coordinated alignment therewith, said second belt carrying a plurality of barrier members having substantially planar cross-sections where said member are adapted to be situated in closely spaced relation above said containers and below said filling means, where said barries are provided with an appropriately spaced aperture therethrough to allow for the downward passage of said products into said containers; and means to automatically remove contaminants derived from said product from said barrier members as said members are carried along the second belt.

2. The apparatus of claim 1 wherein said barriers are provided with a downwardly, distending lip which fits below the upper open end of the container when said container is situated below said filling means.

3. The apparatus of claim 2 wherein said lip describes a funnel-like shape when viewed in cross section.

4. The apparatus of claim 1 further including means on said first and second belts to physically establish alignment between the barrier members and the containers.

5. The apparatus of claim 4 wherein said means on said first and second belts to physically establish alignment comprises a tapered pin carrier by said second belt and a corresponding oversized aperture disposed in said first belt.

6. The apparatus of claim 5 wherein said barrier members are provided with elongated slots slidably receivable in the second belt such that said barrier members may undergo longitudinal movement relative to said second belt subsequent to the introduction of said tapered pin in said aperture.

7. An apparatus for substantially reducing the contamination of the sealing surface of a container having a sealing flange about its upper, open end, comprising:

a first and a second endless belt disposed one above the other in longitudinal and operative alignment where said lower belt is adapted to carry said containers in a substantially continuous spaced relation;

means to ensure alignment between the upper and lower belts, said means including a series of protrusions disposed on the lower belt receivable in oversized apertures formed in the upper belt;

an automatic food dispensing apparatus disposed above said lower belt such that a given product may be placed in said tray;

said upper belt adapted to carry a series of shield members having substantially planar cross-sections where said members are configured to securely fit above said containers during the dispensing of said product therein, where said shield members are provided with apertures to allow for the passage of said products therethrough, said shield members also provided with a distending lip which extends below the sealing flange of said container during the dispensing of said product into said container.

8. The apparatus of claim 7 wherein said lower belt is comprised of a series of tray supporting members configured to fixedly accommodate said containers.

9. An apparatus for filling material into containers which have a sealing flange around their upper open end, comprising:

a conveyor system including (a) a lower endless belt including a laterally traveling upper section adapted to support a plurality of said containers in spaced relation along the upper section;

(b) an upper endless belt including a laterally traveling lower section adapted to travel above and synchronously with the upper section of the lower belt with the containers positioned vertically between the two sections;

(c) a plurality of shield members having substantially planar cross-sections which are mounted along and extending outward from the upper belt and spaced along the upper belt such that one such shield is positioned above and travels synchronously with each said container as the container travels on the upper section of the lower belt, each shield configured to enter the upper open end of its respective container in closely spaced relation with said upper open end so as to shield the flange around the upper open end from material within the container; and a filling member configured to deposit material in each container through its respective shield when the shield is positioned within the open end of the containers.

10. A conveyer system for filling containers which have an open upper end surrounded by a sealing flange, which comprises:

a first endless belt having a plurality of receptacles spaced along its length and shaped to include a laterally disposed upper section, where said first belt defines an upstream and downstream end, each receptacle configured to receive and support said container by its sealing flange when the receptacles are traveling with said upper section;

a second endless belt positioned above the first endless belt and shaped to include a laterally disposed lower section spaced above and aligned with said upper section of said first belt where said second belt also defines an upstream and downstream end;

both said belts, including said upper and lower sections, adapted to be driven in synchronism;

a plurality of substantially planar shield members mounted in spaced relation along the second belt and projecting outward from the second belt, said shield members spaced along the second belt and configured such that successive shield members enter the open upper ends of successive containers at the upstream ends of said upper and lower section, exit the open upper ends at the downstream ends of said upper and lower section, and shield the sealing flanges of the containers from material within the containers when projecting within the containers.

11. The system of claim 10 further comprising a drip guard positioned at the downstream ends of said upper section of said first belt and said lower section of said second belt and configured to deflect drippage, if any, from the shield members as they exit their containers from dripping on the containers.

12. The system of claim 10 further comprising a fill conduit positioned along the upper and lower sections.

13. The system of claim 10 further comprising a sanitizer positioned along one or both endless belts, said sanitizer adapted to remove contaminating material from said endless belts.

14. A conveyor system as recited in claim 10 wherein said shield members are projecting outward from the second belt.

15. A conveyor system as recited in claim 10 wherein each said shield member includes a flared portion at their projecting ends, said flared portions adapted to prevent drips from said shield member.

16. The endless conveyor belt as recited in claim 10 further defining a plurality of openings spaced along the raid first endless belt, each opening adapted to receive the closed end of a container having a sealing flange at its open end; and a raised shoulder on the outer surface of the belt surrounding each said opening and adapted to seat gainst the sealing flange of the container positioned in the opening.

17. Apparatus for filling containers which have an open upper end and a sealing surface around the upper sealing end, comprising:

a first, laterally disposed conveyor adapted to support a plurality of such containers in spaced relation along a direction of travel of the conveyor with the open ends of the containers facing up;

a second laterally disposed conveyor positioned above and aligned with first conveyor and adapted to travel in synchronism with the first conveyor;

a plurality of sleeve-like shield members having substantially planar cross-sections where said members depend from the second conveyor and spaced along the second conveyor such that the longitudinal axes of successive sleeve-like shield members center above successive containers on the first conveyor when both conveyor travel in synchronism, each sleeve-like shield member configured to fit within the open end of its respective container and to shield the upper end surface of the container from material within the container;

each sleeve-like shield member further configured to enable a fill conduit to deposit material through the sleeve-like shield member into the container.

* * * * *